US009488930B2

(12) United States Patent
Yoneima

(10) Patent No.: US 9,488,930 B2
(45) Date of Patent: Nov. 8, 2016

(54) DEVELOPING DEVICE AND IMAGE FORMING APPARATUS

(71) Applicant: KYOCERA Document Solutions Inc., Osaka-shi, Osaka (JP)

(72) Inventor: Yoshinobu Yoneima, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/942,892

(22) Filed: Nov. 16, 2015

(65) Prior Publication Data

US 2016/0147173 A1 May 26, 2016

(30) Foreign Application Priority Data

Nov. 20, 2014 (JP) ..... 2014-235806

(51) Int. Cl.

| | |
|---|---|
| ***G03G 15/08*** | (2006.01) |
| ***G03G 13/09*** | (2006.01) |
| ***G03G 15/09*** | (2006.01) |
| ***G03G 15/06*** | (2006.01) |

(52) U.S. Cl.

CPC ..... *G03G 15/0822* (2013.01); *G03G 13/09* (2013.01); *G03G 15/065* (2013.01); *G03G 15/08* (2013.01); *G03G 15/0806* (2013.01); *G03G 15/09* (2013.01); *G03G 15/0907* (2013.01); *G03G 2215/0609* (2013.01)

(58) Field of Classification Search

CPC ..... G03G 15/0822; G03G 15/065; G03G 15/0806; G03G 15/09; G03G 15/0907; G03G 15/08; G03G 13/09; G03G 2215/0609

See application file for complete search history.

(56) References Cited

U.S. PATENT DOCUMENTS

2002/0039496 A1* 4/2002 Aoki ..... G03G 13/08 399/55

FOREIGN PATENT DOCUMENTS

JP 2010091804 A 4/2010

* cited by examiner

*Primary Examiner* — Ryan Walsh

(74) *Attorney, Agent, or Firm* — Alleman Hall McCoy Russell & Tuttle LLP

(57) ABSTRACT

When rotation speed of second rotator is greater than or equal to a threshold previously determined, first control portion causes first generation portion to generate a first potential difference that enables toner in a predetermined amount to be transferred from first rotator to second rotator, and causes second generation portion to generate a second potential difference that enables the toner in the predetermined amount to be transferred from second rotator to a electrostatic latent image. When the rotation speed is less than the threshold, second control portion causes first generation portion to generate a third potential difference that enables the toner in an amount exceeding the predetermined amount to be transferred from first rotator to second rotator, and causes second generation portion to generate a fourth potential difference that enables the toner in the predetermined amount to be transferred from second rotator to the electrostatic latent image.

7 Claims, 6 Drawing Sheets

DEVELOPING DEVICE AND IMAGE FORMING APPARATUS

INCORPORATION BY REFERENCE

This application is based upon and claims the benefit of priority from the corresponding Japanese Patent Application No. 2014-235806 filed on Nov. 20, 2014, the entire contents of which are incorporated herein by reference.

BACKGROUND

The present disclosure relates to a developing device which converts by electrophotography an electrostatic latent image into a manifest image, and relates to an image forming apparatus equipped with the developing device.

A typical developing device transfers toner included in a developer containing portion from a first rotational body to a second rotational body, and then, supplies the toner from the second rotational body to a photosensitive member. In a developing device of this type, toner is transferred from the developer containing portion to the first rotational body, the toner is transferred from the first rotational body to the second rotational body, and then, the toner is transferred from the second rotational body to the photosensitive member. Such transfer of the toner is performed by generating a potential difference between the first rotational body and the second rotational body, and a potential difference between the second rotational body and an electrostatic latent image formed on the photosensitive member.

When the photosensitive member is exposed and an electrostatic latent image is formed on the exposed portion, an edge electric field is generated in the boundary part (hereinafter, referred to as edge part") with a non-exposed portion in the exposed portion. The edge electric field is an electric field generated due to the potential difference between the exposed portion and the non-exposed portion, and is also referred to as insulation electric field. That is, in the edge part of the exposed portion, the edge electric field is generated in addition to an electric field generated due to the potential difference between the electrostatic latent image and the second rotational body. Thus, the strength of the electric field in the edge part is greater than that in the other part of the exposed portion. Thus, a phenomenon occurs in which the amount of toner adhering to the edge part of the exposed portion is greater than the amount of toner adhering to the part other than the edge part of the exposed portion. This phenomenon is referred to as edge phenomenon.

Here, in the case where a recording sheet on which to form an image in the image forming apparatus is, for example, thick paper, when a fixing process is performed by a fixing device, a large amount of heat is taken by the thick paper compared with that in the case of an ordinary recording sheet. In this case, there is a risk of causing insufficient fixation of the toner to the thick paper. Thus, in a typical image forming apparatus, a series of image forming speeds (hereinafter, also simply referred to as image forming speed) including the conveying speed of the thick paper and the developing speed by the developing device are set to be slower than those in the case where image forming is performed on a recording sheet having an ordinary thickness. Accordingly, a sufficient amount of heat is provided to the thick paper during the fixing process.

Also when the image forming mode is a mode in which an image is formed at a high resolution, there are cases where the image forming speed is set to be slower than that in the case where image forming is performed on a recording sheet at an ordinary resolution.

If the image forming speed is set to be slower than the speed in ordinary time, the time period in which the toner can be transferred to the edge part of the exposed portion is extended, and the amount of toner adhering to the edge part of the exposed portion due to the electric field near the boundary is further increased. Thus, the edge phenomenon appears in a noticeable manner, which can cause a problem of reduced image quality, such as a line image becoming thicker than that in image data.

SUMMARY

A developing device according to one aspect of the present disclosure includes a first rotational body, a second rotational body, a first generation portion, a second generation portion, a first control portion, and a second control portion. The first rotational body carries a developer contained in a developer containing portion. The second rotational body is disposed so as to face the first rotational body and receives and carries toner included in the developer from the first rotational body, to convey the toner to a position at which the toner is transferred to a photosensitive member on which an electrostatic latent image is formed. The first generation portion generates a potential difference between the first rotational body and the second rotational body. The second generation portion generates a potential difference between the second rotational body and the electrostatic latent image. When a rotation speed of the second rotational body is greater than or equal to a threshold previously determined, the first control portion causes the first generation portion to generate a first potential difference that enables the toner in a predetermined amount defined in accordance with a reference density for a toner image to be formed on the electrostatic latent image, to be transferred from the first rotational body to the second rotational body, and causes the second generation portion to generate a second potential difference that enables the toner in the predetermined amount to be transferred from the second rotational body to the electrostatic latent image. When the rotation speed is less than the threshold previously determined, the second control portion causes the first generation portion to generate a third potential difference that enables the toner in an amount exceeding the predetermined amount to be transferred from the first rotational body to the second rotational body, and causes the second generation portion to generate a fourth potential difference that enables the toner in the predetermined amount to be transferred from the second rotational body to the electrostatic latent image.

An image forming apparatus according to one aspect of the present disclosure includes the developing device, a photosensitive member, and a transfer portion. On the photosensitive member, the electrostatic latent image is formed and the electrostatic latent image is converted into a manifest image with the toner supplied from the developing device. The transfer portion transfers the toner image formed on the photosensitive member to a recording sheet, to form an image on the recording sheet.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Further-more, the claimed subject matter is not limited to implementations that solve any or all disadvantages noted in any part of this disclosure.

DETAILED DESCRIPTION

Hereinafter, embodiments of the present disclosure will be described with reference to the attached drawings.

First Embodiment

Figure 1:
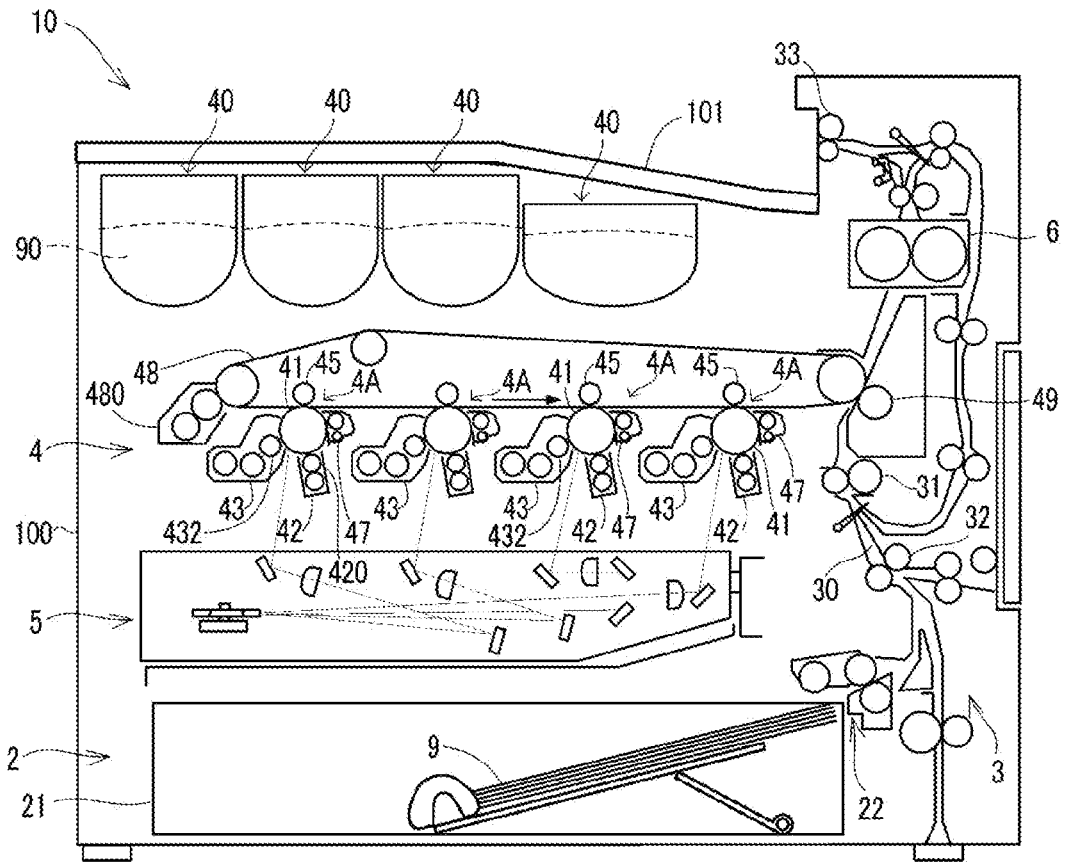
FIG. 1 is a configuration diagram of an image forming apparatus according to a first embodiment of the present disclosure.

First, with reference to FIG. 1 and FIG. 2, a configuration of an image forming apparatus 10 according to a first embodiment of the present disclosure will be described. The image forming apparatus 10 is an electrophotographic image forming apparatus. As shown in FIG. 1, the image forming apparatus 10 includes a sheet feed portion 2, a sheet conveying portion 3, toner supply portions 40, an image forming portion 4, an optical scanning portion 5, a fixing portion 6, and the like in a housing 100.

The image forming apparatus 10 shown in FIG. 1 is a tandem type image forming apparatus, and is a color printer. Thus, the image forming portion 4 further includes an intermediate transfer belt 48, a cleaning device 480, and a secondary transfer device 49.

The image forming portion 4 includes a plurality of single color image forming portions 4A respectively corresponding to colors of cyan, magenta, yellow, and black. Further, the image forming apparatus 10 includes a plurality of toner supply portions 40 which supply toners of colors of cyan, magenta, yellow, and black to later-described developer containing portions 4300 (see FIG. 2) of later-described developing devices 43, respectively. Each toner supply portion 40 is removably mounted at a previously determined position in the image forming apparatus 10. In the present embodiment, each toner supply portion 40 is mounted at an upper position in the image forming portion 4.

The image forming apparatus 10 is, for example, a printer, a copy machine, a facsimile machine, a multifunction peripheral, or the like. The multifunction peripheral also has the function of the printer, the function of the copy machine, and the like.

The sheet feed portion 2 includes a sheet receiving portion 21 and a sheet sending-out portion 22. The sheet receiving portion 21 is configured such that a plurality of recording sheets 9 can be placed thereon in a stacked manner. Each recording sheet 9 is a sheet-like medium on which an image is to be formed, such as paper, coated paper, a postcard, an envelope, an OHP sheet, or the like.

The sheet sending-out portion 22 rotates in contact with the recording sheet 9, to send out the recording sheet 9 from the sheet receiving portion 21 toward a conveying path 30.

The sheet conveying portion 3 includes registration rollers 31, conveying rollers 32, discharge rollers 33, and the like. The registration rollers 31 and the conveying rollers 32 convey the recording sheet 9 fed from the sheet feed portion 2, toward the secondary transfer device 49 of the image forming portion 4. Further, the discharge rollers 33 discharge the recording sheet 9 on which an image has been formed, from the discharge outlet of the conveying path 30 onto a discharge tray 101.

The intermediate transfer belt 48 is an endless belt-like member formed in a loop shape. The intermediate transfer belt 48 rotates in a state of being extended on and between two rollers. In the image forming portion 4, each single color image forming portion 4A forms an image of the color thereof on the surface of the intermediate transfer belt 48 which is rotating. Accordingly, a color image on which images in the respective colors are superposed is formed on the intermediate transfer belt 48.

The secondary transfer device 49 transfers, to the recording sheet 9, a toner image formed on the intermediate transfer belt 48. The cleaning device 480 removes toner remaining on a portion, of the intermediate transfer belt 48, that has passed through the secondary transfer device 49.

Each single color image forming portion 4A includes a photosensitive drum 41 which carries a toner image, a charging device 42, a developing device 43, a primary transfer device 45, a cleaning device 47, and the like. On the photosensitive drum 41, an electrostatic latent image is formed, and the electrostatic latent image is converted into a manifest image with the toner supplied from the developing device 43. Each primary transfer device 45 and the secondary transfer device 49 are one example of the transfer portion of the present disclosure which transfers the toner image formed on the photosensitive drum 41 to a recording sheet 9. The cleaning device 47 removes, from the photosensitive drum 41, toner remaining on the photosensitive drum 41 after a transfer process executed by the primary transfer device 45.

Each photosensitive drum 41 rotates at a circumferential speed in accordance with the circumferential speed (movement speed) of the intermediate transfer belt 48. For example, as the photosensitive drum 41, an organic photosensitive member or an amorphous silicon photosensitive member can be employed.

The image forming apparatus 10 is provided with a density detection portion 600. The density detection portion 600 detects the density of a toner image formed on the surface of the photosensitive drum 41. As the density detection portion 600, a well-known reflective photosensor having a light emitting portion and a light receiving portion can be employed.

It should be noted that the density detected by the density detection portion 600 is not limited to the density of a toner image formed on the surface of the photosensitive drum 41, and may be, for example, the density of a toner image to be transferred to the intermediate transfer belt 48 or the density of an image transferred on the recording sheet 9.

In each single color image forming portion 4A, the photosensitive drum 41 rotates, and the charging device 42 uniformly charges the surface of the photosensitive drum 41. Further, the optical scanning portion 5 performs scanning with laser light, thereby writing an electrostatic latent image on the charged surface of the photosensitive drum 41.

The developing device 43 develops the electrostatic latent image by supplying toner to the photosensitive drum 41. The developing device 43 in the present embodiment causes toner to be charged by agitating a two-component developer 90 including toner and carrier, and supplies the charged toner to the photosensitive drum 41.

The charging device 42 includes a charging roller 420 which charges a portion, of the photosensitive drum 41, on which the electrostatic latent image has not yet been written.

The image forming apparatus 10 has a plurality of image forming modes respectively having different image resolutions. In the present embodiment, the image forming apparatus 10 has two kinds of image forming mode, i.e., a high resolution mode for a high resolution, and a low resolution mode for a low resolution.

The image forming apparatus 10 is communicably connected to another communication apparatus. The other communication apparatus is, for example, a personal computer. The image forming apparatus 10 executes an image forming job requested by the other communication apparatus. Job information of the image forming job includes information such as the kind of the image forming mode, the kind of the recording sheet, and the like. The image forming mode includes the high resolution mode, the low resolution mode, and the like. The kind of the recording sheet 9 includes plain paper, thick paper, and the like.

Figure 2:
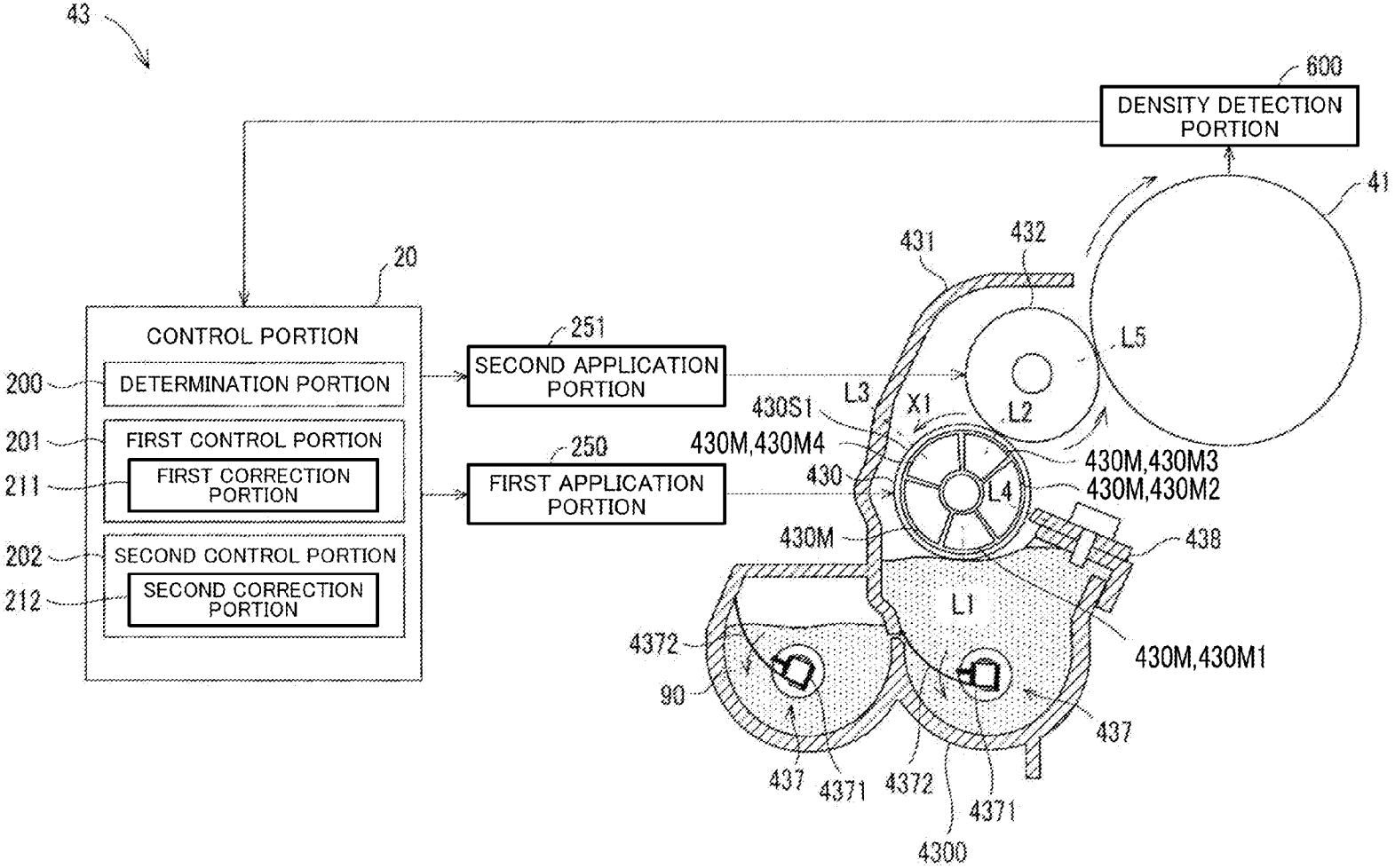
FIG. 2 is a configuration diagram of a photosensitive drum and a developing device in an image forming portion of the image forming apparatus according to the first embodiment of the present disclosure.

As shown in FIG. 2, the developing device 43 has a device body 431. The developing device 43 includes a magnetic roller 430, a developing roller 432, an agitation mechanism 437, and a blade 438. These members are provided inside the device body 431. The magnetic roller 430, the developing roller 432, and the agitation mechanism 437 are rotatably supported about the rotation axes thereof which are parallel to one another.

A lower portion of the device body 431 is the developer containing portion 4300 which contains the two-component developer 90. The toner is supplied from the toner supply portion 40 (see FIG. 1). The toner is formed from resin, and the carrier is formed from a magnetic material. The particle size of the toner is smaller than the particle size of the carrier. The toner is lighter in weight than the carrier. The carrier is magnetic particles formed of ferrite, or the like. As described later, the carrier is agitated while being mixed with the toner, whereby the toner is charged with static electricity that occurs from the friction between the toner and the carrier. With the presence of the carrier, in the two-component developer 90, the toner can be more easily charged, than in the case of a one-component developer consisting of toner alone, and thus, high quality of the image can be realized.

The agitation mechanism 437 is rotatably provided inside the developer containing portion 4300. The agitation mechanism 437 agitates the two-component developer 90 in the developer containing portion 4300.

The agitation mechanism 437 includes a rotation shaft portion 4371 and an agitating member 4372.

The rotation shaft portion 4371 is a shaft member formed in a shape that is long in a direction orthogonal to the drawing plane of FIG. 2. The rotation shaft portion 4371 is rotatably supported by side walls (not shown) at opposite ends in the direction orthogonal to the drawing plane of FIG. 2 of the developer containing portion 4300.

The agitating member 4372 is formed from an elastic material such as a PET (polyethylene terephthalate) resin, and is formed in a film shape having a small thickness. The material of the agitating member 4372 is not limited to a PET resin, and may be a synthetic resin such as vinyl chloride, polycarbonate, or the like.

The agitating member 4372 is formed in a shape that is long along the longitudinal direction of the rotation shaft portion 4371. The agitating member 4372 is attached to the rotation shaft portion 4371. In the present embodiment, the rotation shaft portion 4371 has a planar adhesion surface (not shown). An edge portion of the agitating member 4372 is bonded with an adhesive to the adhesion surface of the rotation shaft portion 4371. The agitating member 4372 has an extended portion which is extended in a direction orthogonal to the axial direction of the rotation shaft portion 4371.

When the agitating member 4372 is driven to rotate, the extended portion moves in the two-component developer 90 in the developer containing portion 4300. Accordingly, the two-component developer 90 in the developer containing portion 4300 is agitated. This agitation causes friction between the toner and the carrier, and the toner is charged with static electricity caused by this friction, to a previously determined polarity. The carrier is charged to a polarity opposite to the polarity to which the toner is charged. Then, the toner adheres to the carrier under electrostatic force.

The magnetic roller 430 is rotatably provided inside the developer containing portion 4300. The magnetic roller 430 attracts the two-component developer 90 agitated by the agitation mechanism 437, from the developer containing portion 4300 with magnetic force thereof, and carries the two-component developer 90 on the surface of the magnetic roller 430.

The magnetic roller 430 includes a sleeve portion 430S1 and magnets 430M.

The sleeve portion 430S1 has a cylindrical shape, and serves as the surface of the magnetic roller 430. The sleeve portion 430S1 is composed of a nonmagnetic member. The sleeve portion 430S1 is rotatable in forward/reverse directions. The sleeve portion 430S1 rotates in one direction during a developing process. In the present embodiment, the sleeve portion 430S1 is driven to rotate in a rotation direction X1 (counterclockwise direction in FIG. 2) in FIG. 2 during the developing process.

The circumferential speed (rotation speed) of the sleeve portion 430S1 is set to be different between the high resolution mode and the low resolution mode. The circumferential speed of the sleeve portion 430S1 in the high resolution mode is set to a first speed V1 which is slower than a threshold Vth previously determined. The circumferential speed of the sleeve portion 430S1 in the low resolution mode is set to a second speed V2 which is greater than or equal to the threshold Vth. That is, the first speed V1 is slower than the second speed V2. Thus, the circumferential speed of the sleeve portion 430S1 is slower in the high resolution mode, than in the low resolution mode. In the present embodiment, the sleeve portion 430S1 is one example of the first rotational body.

The circumferential speed of the sleeve portion 430S1 is set to be different between the case where the recording sheet is plain paper and the case where the recording sheet is thick paper. The circumferential speed of the sleeve portion 430S1 in the case where the recording sheet is thick paper is set to the first speed V1. The circumferential speed of the sleeve portion 430S1 in the case where the recording sheet is plain paper is set to the second speed V2. That is, the circumferential speed of the sleeve portion 430S1 is slower in the case where the recording sheet is thick paper than in the case where the recording sheet is plain paper.

Hereinafter, the mode in which the sleeve portion 430S1 rotates at the first speed V1 will be referred to as slow mode and the mode in which the sleeve portion 430S1 rotates at the second speed V2 will be referred to as fast mode. The threshold Vth is a set speed defined in a speed range less than a previously determined speed, and is 300 mm/sec, for example.

A plurality of magnets 430M are provided inside the sleeve portion 430S1. The plurality of magnets 430M are arranged with a predetermined interval therebetween along the circumferential direction. The positions of the magnets 430M are fixed in the sleeve portion 430S1. The plurality of magnets 430M include a magnet 430M1, a magnet 430M2, a magnet 430M3, and a magnet 430M4.

The magnet 430M1 is provided at a position opposed to the two-component developer 90 in the developer containing portion 4300. The magnet 430M1 attracts the two-component developer 90 contained in the developer containing portion 4300. Accordingly, the two-component developer 90 adheres to the portion opposed to the magnet 430M1 of the surface of the sleeve portion 430S1 in the magnetic roller 430. A position L1 shown in FIG. 2 indicates a transfer position at which the two-component developer 90 contained in the developer containing portion 4300 is transferred to the sleeve portion 430S1.

The magnet 430M2 is provided at a position adjacent to the magnet 430M1 and on the downstream side in the rotation direction X1 relative to the magnet 430M1. The magnet 430M2 causes the sleeve portion 430S1 to carry the two-component developer 90.

Under the magnetic force of the magnet 430M1 and the magnet 430M2, a developer layer is formed on the surface of the sleeve portion 430S1. On this developer layer, a magnetic brush (not shown) is formed.

The magnetic brush is formed in the following manner: a plurality of carrier particles included in the two-component developer 90 are connected together to form a plurality of chains on the surface of the magnetic roller 430 under the magnetic force of the magnets 430M1 and 430M2, resulting in a stack of the chains of carrier particles.

As described later, a voltage is applied to each of the magnetic roller 430 and the developing roller 432. Thus, previously determined potential differences are generated between the magnetic roller 430 and the developing roller 432, and between the developing roller 432 and the electrostatic latent image formed on the photosensitive drum 41. Due to the potential difference, the toner included in the two-component developer 90 carried by the magnetic roller 430 is transferred to the developing roller 432. A position L2 shown in FIG. 2 indicates a transfer position at which the toner included in the two-component developer 90 carried by the magnetic roller 430 is transferred to the developing roller 432.

As described above, the magnetic roller 430 is rotatably supported in the developer containing portion 4300. The magnetic roller 430 rotates in the rotation direction X1, thereby carrying the two-component developer 90 on the surface thereof, and conveying the toner included in the two-component developer 90 to the position L2 at which the toner is transferred to the developing roller 432.

The magnet 430M3 is provided at a position opposed to the developing roller 432, and attracts, to the sleeve portion 430S1, the carrier remaining on the magnetic roller 430 as a result of the toner having been transferred to the developing roller 432 at the position L2. The carrier attracted to the sleeve portion 430S1 by the magnet 430M3 keeps the state where the magnetic brush is formed.

After the toner has been transferred to the developing roller 432 at the position L2, the magnet 430M4 separates with the magnetic force thereof, the carrier remaining on the surface of the magnetic roller 430, from the surface, and causes the carrier to drop into the developer containing portion 4300 located below. A position L3 shown in FIG. 2 indicates a separation position at which the carrier remaining on the surface of the magnetic roller 430 is separated from the surface with the magnetic force.

During the developing process, the magnetic roller 430 receives the two-component developer 90 from the developer containing portion 4300 at the position L1 with the magnetic force of the magnet 430M1, and conveys the two-component developer 90 through rotation of the sleeve portion 430S1 in the rotation direction X1. When the two-component developer 90 has been conveyed to the position L2, the toner included in the two-component developer 90 is transferred to the developing roller 432 on the next stage, due to the potential difference between the magnetic roller 430 and the developing roller 432. At this time, the carrier remains on the surface of the magnetic roller 430.

The magnetic roller 430 conveys the carrier to the position L3 through further rotation of the sleeve portion 430S1 in the rotation direction X1. When having conveyed the carrier to the position L3, the magnetic roller 430 causes the carrier to be detached from the magnetic roller 430, with repulsive force acting between the carrier and the magnet 430M4. Accordingly, the separated carrier drops into the developer containing portion 4300 located below.

The blade 438 is provided, spaced from the surface of the magnetic roller 430, at a position L4 on the upstream side in the rotation direction X1 relative to the position L2 on the outer circumference of the magnetic roller 430. The blade 438 regulates the thickness of the layer of the two-component developer 90 carried by the magnetic roller 430 rotating in the rotation direction X1. The position L4 is a position at which the blade 438 regulates the thickness of the layer of the two-component developer 90 carried by the magnetic roller 430 rotating in the rotation direction X1. In the present embodiment, the position L3 and the position L4 are arranged at positions substantially opposite to each other relative to the rotation axis of the magnetic roller 430.

The developing roller 432 is disposed so as to face the magnetic roller 430, and receives, from the magnetic roller 430, the toner included in the two-component developer 90 carried by the magnetic roller 430, and carries the toner. On the surface of the developing roller 432, a toner layer is formed from the toner.

The developing roller 432 faces the photosensitive drum 41 in a non-contact state. As described above, a voltage is applied to the developing roller 432. Accordingly, a previously determined potential difference is generated between the developing roller 432 and the electrostatic latent image formed on the photosensitive drum 41. Due to the potential difference, the toner carried by the developing roller 432 is transferred to the portion of the electrostatic latent image formed on the outer circumferential surface of the photosensitive drum 41. A position L5 shown in FIG. 2 indicates a transfer position at which the toner carried by the developing roller 432 is transferred to the portion of the electrostatic latent image formed on the outer circumferential surface of the photosensitive drum 41. The developing roller 432 conveys the toner to the transfer position L5 at which the toner is transferred to the photosensitive drum 41 in which the electrostatic latent image is formed on the surface thereof. The developing roller 432 is one example of the second rotational body of the present disclosure.

The developing roller 432 rotates in the same direction as the rotation direction X1 during the developing process. Accordingly, the portions, of the outer circumferential surfaces of the magnetic roller 430 and the developing roller 432, that face each other move in reverse directions, respectively.

In addition, during the developing process, the developing roller 432 and the photosensitive drum 41 rotate in reverse directions with each other. Accordingly, the portions, of the outer circumferential surfaces of the developing roller 432 and the photosensitive drum 41, that face each other move in the same direction.

In this manner, the toner included in the two-component developer 90 is consumed during the developing process. Thus, the toner is supplied from the toner supply portion 40 into the developer containing portion 4300, to supplement the consumed amount. On the other hand, the carrier included in the two-component developer 90 will remain in the developer containing portion 4300 with scarcely being consumed, and provides flowability and the like to the toner supplied to the developer containing portion 4300.

The developing device 43 includes a first application portion 250 and a second application portion 251. The first application portion 250 applies a voltage to the magnetic roller 430. The second application portion 251 applies, to the developing roller 432, a voltage that is different from the voltage applied to the magnetic roller 430 by the first application portion 250 and the voltage of the electrostatic latent image formed on the photosensitive drum 41.

Accordingly, previously determined potential differences are generated between the magnetic roller 430 and the developing roller 432, and between the developing roller 432 and the electrostatic latent image formed on the photosensitive drum 41. Due to each potential difference, an electric field is formed. The first application portion 250 and the second application portion 251 are one example of the first generation portion of the present disclosure. The second application portion 251 is one example of the second generation portion of the present disclosure.

The developing device 43 includes a drive motor 203. The drive motor 203 drives the magnetic roller 430 so as to rotate. As the drive motor 203, a DC brushless motor, a stepping motor, or the like can be employed.

The developing device 43 includes a control portion 20. The control portion 20 includes a CPU, a ROM, and a RAM.

The CPU is a processor that executes various kinds of calculation processes. The ROM is a nonvolatile storage portion in which information such as a control program for causing the CPU to execute various kinds of processes is previously stored. The RAM is a volatile storage portion to be used as a temporary storage memory (working area) for various kinds of processes executed by the CPU. The control portion 20 controls operation of the image forming apparatus 10, by the CPU executing the control program stored in the ROM.

Figure 3:
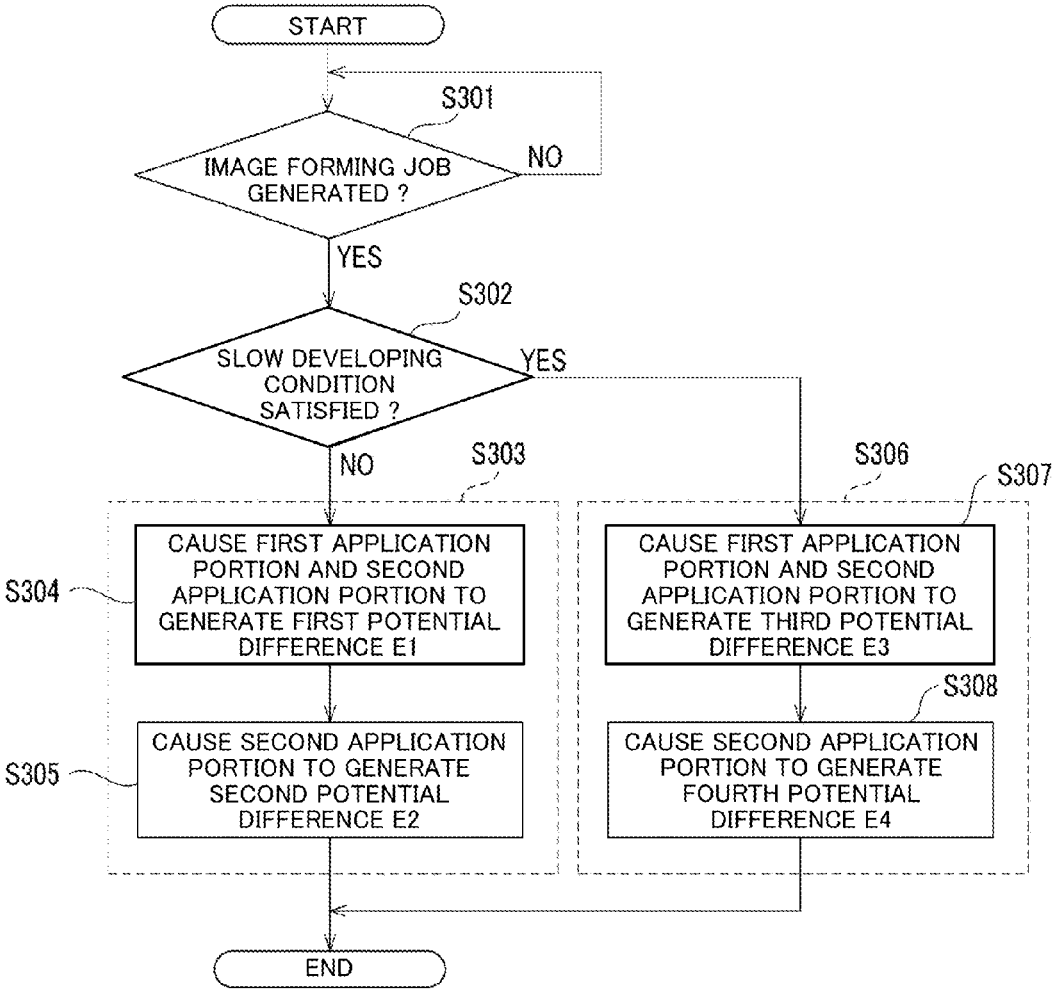
FIG. 3 is a flow chart of a developing process executed by a control portion.

In the ROM of the control portion 20, a processing program is stored which causes the CPU of the control portion 20 to execute the developing process described later (see the flow chart in FIG. 3). The processing program may be stored in the ROM at the time of shipment of the image forming apparatus 10. Alternatively, the processing program may be stored in a computer-readable information storage medium such as a CD, a DVD, or a flash memory, and after the shipment, the processing program may be stored in the ROM of the control portion 20 from the information storage medium.

Meanwhile, when the photosensitive drum 41 is exposed and an electrostatic latent image is formed on the exposed portion, an edge electric field is generated in the edge part which is the boundary part with the non-exposed portion in the exposed portion. The edge electric field is an electric field generated due to the potential difference between the exposed portion and the non-exposed portion. That is, in the edge part of the exposed portion, the edge electric field is generated in addition to the electric field caused by the potential difference between the electrostatic latent image and the developing roller 432. Thus, the strength of the electric field in the edge part is greater than that in the other part of the exposed portion. Thus, the edge phenomenon occurs in which the amount of toner adhering to the edge part of the exposed portion is greater than the amount of toner adhering to the part other than the edge part of the exposed portion.

Here, in the case where a recording sheet 9 on which to form an image in the image forming apparatus 10 is thick paper, for example, when the fixing process is performed by the fixing portion 6, a large amount of heat compared with that in the case of an ordinary recording sheet 9 is taken by the thick paper. In this case, there is a risk of causing insufficient fixation of the toner to the thick paper. Thus, there are cases where a series of image forming speeds including the conveying speed of the thick paper and the developing speed by the developing device 43 are set to be slower than those in the case where an image is formed on a recording sheet 9 having an ordinary thickness, such that a sufficient amount of heat is provided to the thick paper during the fixing process.

Also when the image forming mode is the mode in which an image is formed at a high resolution, there are cases where the series of image forming speeds are set to be slower than those when an image is formed on the recording sheet 9 at an ordinary resolution.

Thus, when the series of image forming speeds are set to be slower than those in ordinary time, the time period in which the toner can be transferred to the edge part of the exposed portion is extended, and the amount of toner adhering to the edge part of the exposed portion due to the electric field near the boundary is further increased. Thus, the edge phenomenon appears in a noticeable manner, which can cause a problem of reduced image quality, such as a line image becoming thicker than usual.

Meanwhile, it is possible to supply the toner to the photosensitive drum 41, by generating the following potential differences between the magnetic roller 430 and the developing roller 432 and between the developing roller 432 and the electrostatic latent image.

That is, between the magnetic roller 430 and the developing roller 432, a potential difference is generated that enables the toner in a predetermined amount to be transferred from the magnetic roller 430 to the developing roller 432, the predetermined amount being defined in accordance with a reference density Dst for a toner image to be formed on the electrostatic latent image. The predetermined amount is a minimum necessary amount for converting the electrostatic latent image into a toner image as a manifest image having the reference density Dst. Meanwhile, between the developing roller 432 and the electrostatic latent image, a potential difference is generated that enables the toner in the predetermined amount to be transferred from the developing roller 432 to the electrostatic latent image. In the present embodiment, this potential difference generation is realized by a later-described first control portion 201 included in the control portion 20. The first control portion 201 will be described in detail later.

However, in the method of supplying the toner to the photosensitive drum 41 by such potential difference generation, a very large potential difference occurs between the developing roller 432 and the electrostatic latent image. In this state, if the series of image forming speeds are decreased, the toner adheres to the edge part of the exposed portion in a more concentrated manner, and thus, the edge phenomenon appears in a more noticeable manner. Accordingly, the image quality is greatly reduced.

Instead of the method of supplying the toner to the photosensitive drum 41 as above, the toner can be supplied to the photosensitive drum 41 by a supply method as described below.

That is, between the magnetic roller 430 and the developing roller 432, a potential difference is generated that enables the toner in an amount exceeding the predetermined amount to be transferred from the magnetic roller 430 to the developing roller 432. Between the developing roller 432 and the electrostatic latent image, a potential difference is generated that enables the toner in the predetermined amount to be transferred from the developing roller 432 to the electrostatic latent image. In the present embodiment, this potential difference generation is realized by a second control portion 202 described later included in the control portion 20. The second control portion 202 will be described in detail later.

However, in the method of supplying the toner to the photosensitive drum 41 by such potential difference generation, the toner in an amount exceeding the predetermined amount defined in accordance with the reference density Dst for the toner image to be formed on the electrostatic latent image is carried by the developing roller 432. Thus, when the series of image forming speeds are set to be fast, there is a risk that the toner carried by the developing roller 432 scatters outwardly from the normal direction relative to the circumferential surface of the sleeve portion 430S1, due to the centrifugal force caused by rotation of the sleeve portion 430S1. This results in greatly reduced image quality, such as occurrence of a fogging phenomenon.

In order to prevent the problem of reduced image quality described above, the image forming apparatus 10 of the present embodiment includes the following configuration.

The control portion 20 has a determination portion 200, the first control portion 201, and the second control portion 202, as a result of the CPU executing the processing program stored in the ROM. It should be noted that a configuration in which part or a plurality of functions of the control portion 20 are implemented as electronic circuits can also be employed.

The determination portion 200 determines whether a fast developing condition is satisfied or a slow developing condition is satisfied, based on the job information of an image forming job inputted to the image forming apparatus 10 from the other communication apparatus mentioned above.

The fast developing condition is a developing condition based on which the sleeve portion 430S1 should be caused to rotate in the fast mode, and is, for example, that the image forming mode of the image forming apparatus 10 is set to the low resolution mode, or that the recording sheet is plain paper. Causing the sleeve portion 430S1 to rotate in the fast mode is causing the sleeve portion 430S1 to rotate at a circumferential speed greater than or equal to the threshold Vth.

The slow developing condition is a developing condition based on which the sleeve portion 430S1 should be caused to rotate in the slow mode, and is, for example, that the image forming mode of the image forming apparatus 10 is set to the high resolution mode, or that the recording sheet is thick paper. Causing the sleeve portion 430S1 to rotate in the slow mode is causing the sleeve portion 430S1 to rotate at a circumferential speed less than the threshold Vth.

When the determination portion 200 determines that the fast developing condition is satisfied, the first control portion 201 controls the first application portion 250 and the second application portion 251 such that a first potential difference E1 is generated between the magnetic roller 430 and the developing roller 432. The first potential difference E1 is a potential difference that enables the toner in the predetermined amount defined in accordance with the reference density Dst for a toner image to be formed on the electrostatic latent image, to be transferred from the magnetic roller 430 to the developing roller 432.

In addition, when the determination portion 200 determines that the fast developing condition is satisfied, the first control portion 201 controls the second application portion 251 such that a second potential difference E2 is generated between the developing roller 432 and the electrostatic latent image. The second potential difference E2 is a potential difference that enables the predetermined amount of toner transferred from the magnetic roller 430 to the developing roller 432 through the application of the first potential difference E1, to be transferred from the developing roller 432 to the electrostatic latent image.

When the determination portion 200 determines that the slow developing condition is satisfied, the second control portion 202 controls the first application portion 250 and the second application portion 251 such that a third potential difference E3 is generated between the magnetic roller 430 and the developing roller 432. The third potential difference E3 is a potential difference that enables the toner in the amount exceeding the predetermined amount to be transferred from the magnetic roller 430 to the developing roller 432.

In addition, when the determination portion 200 determines that the slow developing condition is satisfied, the second control portion 202 controls the second application portion 251 such that a fourth potential difference E4 is generated between the developing roller 432 and the electrostatic latent image. The fourth potential difference E4 is a potential difference that enables the predetermined amount of toner, from the toner in the amount exceeding the predetermined amount having transferred from the magnetic roller 430 to the developing roller 432 through the application of the third potential difference E3, to be transferred from the developing roller 432 to the electrostatic latent image.

The first control portion 201 includes a first correction portion 211. The first correction portion 211 performs a first density correction process in which the first potential difference E1 is corrected such that the toner density for a previously determined toner image to be formed on the photosensitive drum 41 becomes the reference density Dst. The first control portion 201 causes the first application portion 250 and the second application portion 251 to generate the first potential difference E1 obtained through the first density correction process.

The second control portion 202 includes a second correction portion 212. The second correction portion 212 performs a second density correction process in which the fourth potential difference E4 is corrected such that the toner density for a previously determined toner image to be formed on the photosensitive drum 41 becomes the reference density Dst. The second control portion 202 causes the second application portion 251 to generate the fourth potential difference E4 obtained through the second density correction process.

The first correction portion 211 performs the first density correction process every time a previously determined start condition is satisfied. Similarly, the second correction portion 212 performs the second density correction process every time the start condition is satisfied. The start condition will be described later.

As the previously determined toner image, a plurality of kinds of test images (so-called solid image, patch pattern) having different densities can be employed.

Next, with reference to FIG. 3, the developing process executed by the control portion 20 will be described. In the flow chart shown in FIG. 3, step S301, . . . represent the numbers of steps in the processing procedure.

<Step S301>

In step S301, the control portion 20 determines whether an image forming job has been generated based on whether job information of an image forming job had been inputted from the other communication apparatus mentioned above. When determining that the image forming job has not been generated (NO in step S301), the control portion 20 executes the process of step S301 again. On the other hand, when determining that the image forming job has been generated (YES in step S301), the control portion 20 advances the process to step S302.

<Step S302>

When the control portion 20 determines that the image forming job has been generated, the determination portion 200 determines, based on the job information, whether the fast developing condition is satisfied or the slow developing condition is satisfied. That is, the job information includes information such as the kind of the image forming mode and the kind of the recording sheet 9. The kind of the image forming mode includes the high resolution mode, the low resolution mode, and the like. The kind of the recording sheet 9 includes plain paper, thick paper, and the like. The determination portion 200 performs the determination based on these pieces of information included in the job information.

When the determination portion 200 determines that the slow developing condition is not satisfied, i.e., that the fast developing condition is satisfied (NO in step S302), the process is advanced to step S303. On the other hand, when the determination portion 200 determines that the slow developing condition is satisfied (YES in step S302), the process is advanced to step S306.

<Steps S303 to S305>

When the determination portion 200 determines that the slow developing condition is not satisfied, the control portion 20 selects the first control portion 201 and causes the first control portion 201 to perform control. The selected first control portion 201 controls the first application portion 250 and the second application portion 251 (step S303).

That is, the first control portion 201 controls the first application portion 250 and the second application portion 251 such that the first potential difference E1 described above is generated between the magnetic roller 430 and the developing roller 432 (step S304).

In other words, the first control portion 201 causes the first application portion 250 and the second application portion 251 to generate the first potential difference E1 that causes the developing roller 432 to carry a toner layer having a first layer thickness described later. The first layer thickness is a layer thickness that enables the toner in the predetermined amount which is a minimum necessary amount for converting the electrostatic latent image into a toner image as a manifest image having the reference density Dst, to be transferred from the developing roller 432 to the electrostatic latent image.

In addition, the first control portion 201 controls the second application portion 251 described above such that the second potential difference E2 is generated between the developing roller 432 and the electrostatic latent image (step S305). Accordingly, the electrostatic latent image formed on the photosensitive drum 41 is developed into a toner image.

<Steps S306 to S308>

When the determination portion 200 determines that the slow developing condition is satisfied, the control portion 20 selects the second control portion 202 and causes the second control portion 202 to perform control. The selected second control portion 202 controls the first application portion 250 and the second application portion 251 (step S306).

That is, the second control portion 202 controls the first application portion 250 and the second application portion 251 such that the third potential difference E3 described above is generated between the magnetic roller 430 and the developing roller 432 (step S307).

In other words, the second control portion 202 causes the first application portion 250 and the second application portion 251 to generate the third potential difference E3 that causes the developing roller 432 to carry a toner layer having a second layer thickness exceeding the first layer thickness.

In addition, the second control portion 202 controls the second application portion 251 described above such that the fourth potential difference E4 described above is generated between the developing roller 432 and the electrostatic latent image (step S308). Accordingly, the electrostatic latent image formed on the photosensitive drum 41 is developed into a toner image.

Figure 4:
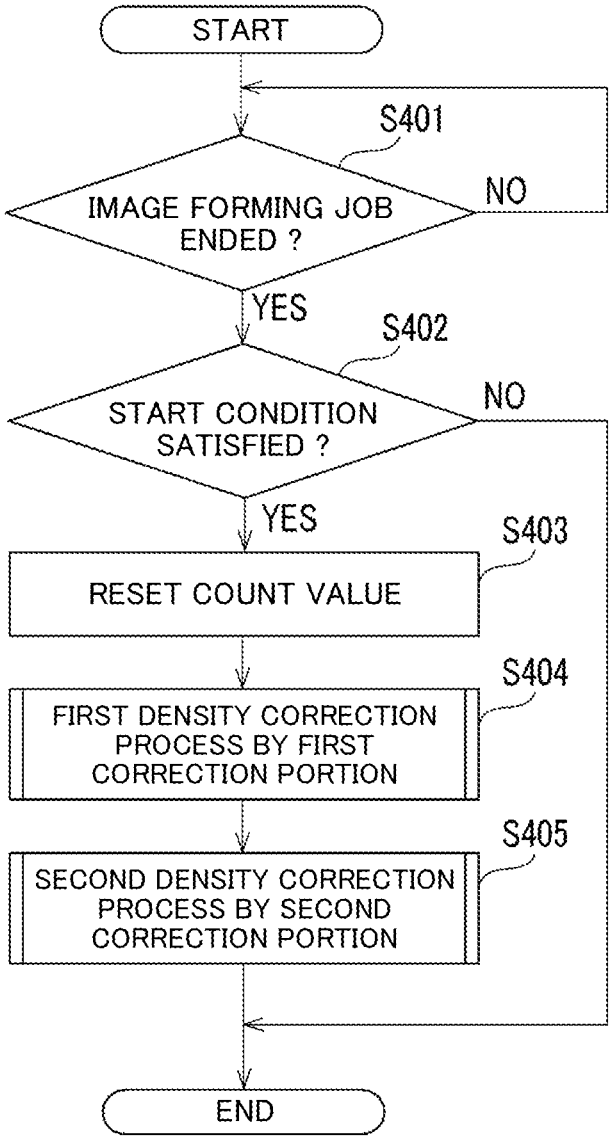
FIG. 4 is a flow chart of a density correction process executed by the control portion.

Next, with reference to FIG. 4, the density correction process executed by the control portion 20 will be described. In the flow chart shown in FIG. 4, step S401, . . . represent the numbers of steps in the processing procedure.

<Step S401>

In step S401, the control portion 20 determines whether the image forming job has ended. When determining that the image forming job has not ended (NO in step S401), the control portion 20 executes the process of step S401 again. On the other hand, when determining that the image forming job has ended (YES in step S401), the control portion 20 advances the process to step S402.

<Step S402>

When determining that the image forming job has ended, the control portion 20 determines, in step S402, whether the start condition based on which a density correction process should be started is satisfied. As the start condition, a condition that the count value of a counter (not shown) described later has exceeded a value indicating a previously determined number of sheets can be employed, for example.

When determining that the start condition is not satisfied (NO in step S402), the control portion 20 ends the process. On the other hand, when determining that the start condition is satisfied (YES in step S402), the control portion 20 advances the process to step S403.

<Step S403>

In step S403, the control portion 20 resets the count value of the counter. The counter counts the number of recording sheets 9 on which image forming has been performed. It is conceivable that the counter is provided in the control portion 20. After executing the process of step S403, the control portion 20 advances the process to step S404.

<Steps S404 and S405>

In step S404, the first correction portion 211 performs the first density correction process. In step S405, the second correction portion 212 performs the second density correction process.

Figure 5:
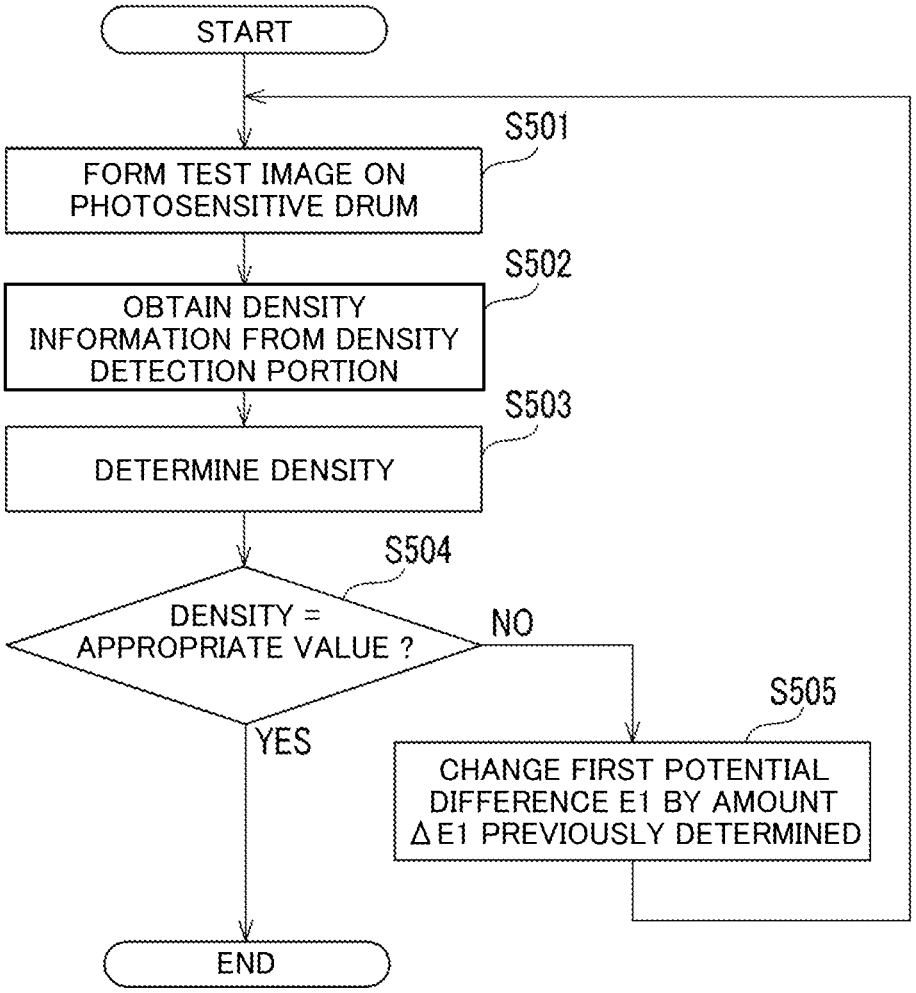
FIG. 5 is a flow chart of a first density correction process executed by a first correction portion and a second density correction process executed by a second correction portion.

With reference to FIG. 5, the first density correction process executed by the first correction portion 211 and the second density correction process executed by the second correction portion 212 will be described.

<Steps S501 and S502>

In step S501, the first correction portion 211 forms a test image on the photosensitive drum 41. Next, in step S502, the first correction portion 211 obtains density information of the test image from the density detection portion 600.

<Steps S503 and S504>

In step S503, the first correction portion 211 determines whether toner density indicated by the density information obtained from the density detection portion 600 is an appropriate value previously determined. As a result, when determining that the toner density is not the appropriate value (NO in step S504), the first correction portion 211 advances the process to step S505. On the other hand, when determining that the toner density is the appropriate value (YES in step S504), the first correction portion 211 ends the first density correction process.

<Step S505>

In step S505, the first correction portion 211 changes the first potential difference E1 by an amount ΔE1 previously determined. Then, the first correction portion 211 returns the process to step S501.

The difference between the second density correction process executed by the second correction portion 212 and the first density correction process executed by the first correction portion 211 shown in FIG. 5 is in the process of step S505. That is, in step S505 of the second density correction process, a process in which the second correction portion 212 changes the fourth potential difference E4 by an amount ΔE4 previously determined.

As described above, when the slow developing condition based on which the sleeve portion 430S1 should be rotated in the slow mode is satisfied, the control by the second control portion 202 is performed. Accordingly, compared with the control executed by the first control portion 201, the amount of toner adhering to the edge part of the exposed portion can be reduced. That is, the magnitude of the occurrence of the edge phenomenon can be reduced. As a result, compared with the control executed by the first control portion 201, reduction in image quality can be prevented.

When the fast developing condition based on which the sleeve portion 430S1 should be rotated in the fast mode is satisfied, the control by the first control portion 201 is performed. In this case, the amount of toner carried by the sleeve portion 430S1 is reduced compared with that in the control executed by the second control portion 202. Accordingly, the amount of toner that scatters from the circumferential surface of the sleeve portion 430S1 due to the centrifugal force caused by rotation of the sleeve portion 430S1 is reduced compared with that in the control executed by the second control portion 202. As a result, occurrence of the fogging phenomenon can be prevented. As a result, compared with the control executed by the second control portion 202, reduction in image quality can be prevented.

Second Embodiment

Figure 6:
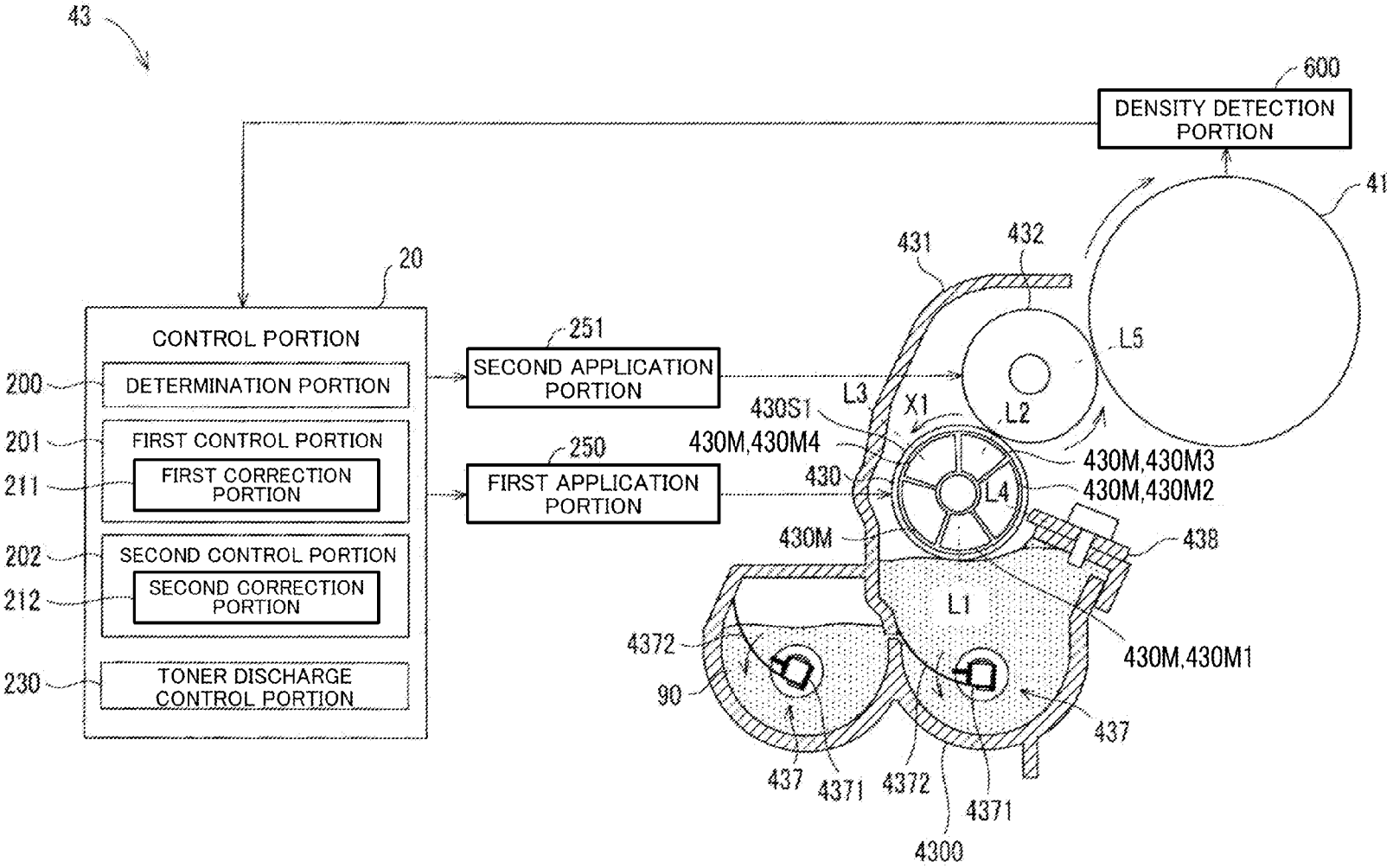
FIG. 6 is a configuration diagram of the photosensitive drum and the developing device in the image forming portion of the image forming apparatus according to a second embodiment of the present disclosure.

A configuration of the image forming apparatus 10 according to a second embodiment of the present disclosure will be described. FIG. 6 is a configuration diagram showing a modification of the image forming apparatus. As shown in FIG. 6, in the present embodiment, the control portion 20 includes a toner discharge control portion 230. The toner discharge control portion 230 performs a discharge process of discharging, from the developing device 43, the two-component developer 90 having deteriorated in the developer containing portion 4300 by use of the cleaning device 47, when image formation is not performed.

That is, when image formation is not performed, the toner discharge control portion 230 causes the developing device 43 to perform a developing process of forming a previously determined toner image on the photosensitive drum 41. The toner discharge control portion 230 causes the cleaning device 47 to remove, from the photosensitive drum 41, the toner forming a toner image having a density of 100%, for example.

Here, in the control executed by the second control portion 202, the amount of toner carried by the developing roller 432 is large, compared with that in the control executed by the first control portion 201. Thus, the amount of deteriorated toner remaining on the developing roller 432 without being transferred from the developing roller 432 to the photosensitive drum 41 is also large in the control executed by the second control portion 202, compared with that in the control executed by the first control portion 201.

Thus, in order to prevent the deteriorated toner from staying in the developing device 43 as much as possible, the toner discharge control portion 230 increases the amount of the toner to be discharged through the discharge process in the control executed by the second control portion 202, compared with that in the control executed by the first control portion 201.

As a form for increasing the amount of the toner to be discharged through the discharge process, a form can be employed, for example, in which the number of formations of a toner image having a density of 100% is increased per discharge process, in accordance with the number of recording sheets 9 on which image forming has been performed.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a first rotational body configured to carry a developer contained in a developer containing portion;

a second rotational body disposed so as to face the first rotational body and configured to receive and carry toner included in the developer from the first rotational body, to convey the toner to a position at which the toner is transferred to a photosensitive member on which an electrostatic latent image is formed;

a first generation portion configured to generate a potential difference between the first rotational body and the second rotational body;

a second generation portion configured to generate a potential difference between the second rotational body and the electrostatic latent image;

a first control portion configured to, when a rotation speed of the second rotational body is greater than or equal to a threshold previously determined, cause the first generation portion to generate a first potential difference that enables the toner in a predetermined amount defined in accordance with a reference density for a toner image to be formed on the electrostatic latent image, to be transferred from the first rotational body to the second rotational body, and cause the second generation portion to generate a second potential difference that enables the toner in the predetermined amount to be transferred from the second rotational body to the electrostatic latent image; and a second control portion configured to, when the rotation speed is less than the threshold previously determined, cause the first generation portion to generate a third potential difference that enables the toner in an amount exceeding the predetermined amount to be transferred from the first rotational body to the second rotational body, and cause the second generation portion to generate a fourth potential difference that enables the toner in the predetermined amount to be transferred from the second rotational body to the electrostatic latent image.

2. The developing device according to claim 1, wherein the first control portion further comprises a first correction portion configured to, when a toner density of a previously determined toner image formed on the photosensitive member has changed from the reference density, correct the first potential difference such that the toner density of the previously determined toner image becomes the reference density, and the first control portion causes the first generation portion to generate the first potential difference having been corrected.

3. The developing device according to claim 1, wherein the second control portion further comprises a second correction portion configured to, when a toner density of a previously determined toner image formed on the photosensitive member has changed from the reference density, correct the fourth potential difference such that the toner density of the previously determined toner image becomes the reference density, and the second control portion causes the second generation portion to generate the fourth potential difference having been corrected.

4. The developing device according to claim 1, wherein the threshold is a set speed defined in a speed range less than a previously determined speed.

5. The developing device according to claim 4, wherein the threshold is a set speed defined in a speed range less than 300 mm/sec.

6. An image forming apparatus comprising:

the developing device according to claim 1;

the photosensitive member on which the electrostatic latent image is formed, and on which the electrostatic latent image is converted into a manifest image with the toner supplied from the developing device; and a transfer portion configured to transfer the toner image formed on the photosensitive member to a recording sheet, to form an image on the recording sheet.

7. The image forming apparatus according to claim 6, further comprising a toner discharge control portion configured to perform a discharge process of discharging the toner from the developing device, by use of a cleaning portion configured to remove, from the photosensitive member, the toner remaining on the photosensitive member after the transfer has been performed by the transfer portion, wherein when image formation is not performed, the toner discharge control portion performs the discharge process of causing the developing device to perform a developing process of forming a previously determined toner image on the photosensitive member, and of causing the cleaning portion to remove, from the photosensitive member, the toner forming the previously determined toner image, and the toner discharge control portion increases the amount of the toner to be discharged through the discharge process in the control performed by the second control portion, compared with that in the control performed by the first control portion.

* * * * *